US005678122A

United States Patent [19]

Gross

[11] Patent Number: 5,678,122

[45] Date of Patent: Oct. 14, 1997

[54] METHOD AND APPARATUS FOR REDUCING TRANSFER DELETIONS

[75] Inventor: Robert A. Gross, Penfield, N.Y.

[73] Assignee: Xerox Corporation, Stamford, Conn.

[21] Appl. No.: 560,778

[22] Filed: Nov. 21, 1995

[51] Int. Cl.[6] ..... G03G 21/00

[52] U.S. Cl. ..... 399/16; 399/388

[58] Field of Search ..... 355/273, 271, 355/274, 276, 208; 430/126, 48

[56] References Cited

U.S. PATENT DOCUMENTS

| | | | |
|---|---|---|---|
| 5,081,500 | 1/1992 | Snelling | 355/273 |
| 5,282,006 | 1/1994 | Fletcher | 355/273 |
| 5,298,955 | 3/1994 | Bean et al. | 355/274 |
| 5,300,993 | 4/1994 | Vetromile | 355/271 |
| 5,300,994 | 4/1994 | Gross et al. | 355/277 |
| 5,311,267 | 5/1994 | Bean | 355/271 |

*Primary Examiner*—R. L. Moses

*Attorney, Agent, or Firm*—William A. Henry, II

[57] ABSTRACT

An electrophotographic printing machine that transfers an image at a transfer work station or zone incorporates an adjustable electromechanical pretransfer paper guide to affect entrance geometry and paper landing position onto a photoreceptor, thereby minimizing image deletion.

6 Claims, 1 Drawing Sheet

METHOD AND APPARATUS FOR REDUCING TRANSFER DELETIONS

BACKGROUND OF THE INVENTION

This invention relates to an electrophotographic printing machine, and more particularly to a copy paper guide arrangement that reduces transfer deletions.

This invention is particularly applicable to high speed xerographic copy reproduction machines. These machines conventionally include an endless xerographic photoreceptor belt that travels through a closed loop path from one station to another. For example, the belt is corona charged at a first station and exposed to an image at a second station. The image is developed at a third station and then proceeds to a fourth station generally known as a transfer station before it is precleaned and the remaining toner removed from the belt for use in the process again.

As is well known in the art, copy sheets are fed from one or more trays and advanced through a copy sheet transport path for operative engagement with the photoreceptor belt at the transfer station. This invention also contemplates receiving paper from a duplex tray where a copy sheet has already passed through the transfer station for imaging on one side, temporarily stored in a duplex tray, and subsequently fed through the transfer station a second time in an inverted state so that the opposite side of the copy sheet is imaged.

In reprographic systems of this type, transfer deletion is often a problem. That is, insufficient contact between the copy sheet and the photoreceptor belt results in incomplete or insufficient transfer of the image from the belt to the sheet. As is known in the art, this image transfer occurs at a transfer station where the paper is charged to receive the image from the photoreceptor belt. Intimate contact between the copy sheet and the photoreceptor belt at the transfer station allows the toner to pass from the photoreceptor to the copy sheet.

Insufficient contact between the photoreceptor belt and the copy sheet can result for various reasons. A primary cause of insufficient contact and transfer deletion is associated with imperfections in the copy sheet, wrinkles or cockles in duplex sheets that have been printed on one side, or pluckers and pockets associated with the copy sheet or photoreceptor belt. Several more quality defects are generated by poor paper path control in the pretransfer paper guide and image transfer region such as misregistration, deletions, lead edge smear, trail edge flip, etc. Optimal paper entry for light weight papers is not optimal for heavy weight papers. Likewise, a system that works for heavy weight papers does not work for light weight papers. For example; it is known to place an "S" bend in the pretransfer paper path to flatten out light weight papers to reduce image deletions. But a paper guide that produces this configuration has a high drag with heavy weight papers that will result in image smear and registration problems.

At one time the use of substantially planar transfer stations was encouraged for different reasons. For example, heavier grade paper has a tendency to separate from the photoreceptor belt, particularly at the trailing edge, resulting in insufficient transfer at that area. In an effort to address this perceived problem, planar transfer zones were encouraged to assure that the entire copy paper received the image from the belt. Nevertheless, it has been observed that more severe transfer deletion problems are associated with planar or flat transfer stations.

Accordingly, it has been deemed desirable to overcome transfer deletion problems, particularly those associated with a planar transfer station.

PRIOR ART

Reduction of transfer deletion in a xerographic copying machine is shown in U.S. Pat. No. 5,311,267 that includes imparting a curvilinear shape to a copy sheet as it passes through at least a portion of the transfer zone by the use of a fixed shoe that constrains movement of a photoreceptor belt thereover. In another embodiment, a roller is used to impart the curvilinear shape to the paper. A baffle can be used with the roller to structure the paper as desired, and the baffle may be moved to vary the shape as the paper moves into the transfer zone.

SUMMARY OF THE INVENTION

The present invention contemplates a new and improved method and apparatus for reducing transfer deletion problems associated with a planar transfer station in a simple and economical manner.

According to the present invention, an electrophotographic printing machine that transfers an image at a transfer work station or zone incorporates an adjustable electromechanical pretransfer paper guide to affect entrance geometry and paper landing position onto a photoreceptor, thereby minimizing image deletion.

According to a more limited aspect of the invention, the electromechanical pretransfer paper guide is actuated by a paper weight sensor to move to a position to guide the paper properly.

Still other advantages and benefits are offered by the subject invention.

BRIEF DESCRIPTION OF THE DRAWINGS

For a better understanding of the invention, as well as other objects and further features thereof, reference is made to the following drawings.

DETAILED DESCRIPTION OF THE INVENTION

Figure 1:
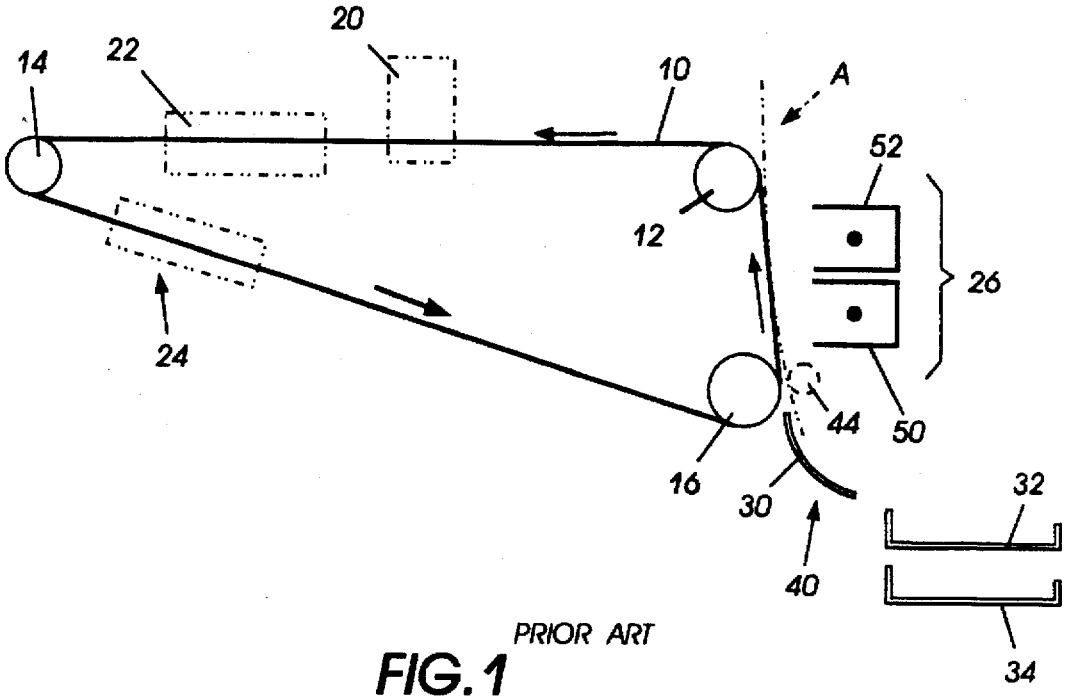
PRIOR ART FIG. 1
FIG. 1 is a schematic representation of a prior art arrangement particularly highlighting the transfer zone in a xerographic apparatus and method.

Referring now to the drawings wherein the showings are for purposes of illustrating the preferred embodiments and method of invention only and not for purposes of limiting same, the FIGURES show one portion of a xerographic copy reproduction machine A. Details of the overall xerographic process and printing machines of this general type are well known so that discussion of those overall features herein is deemed unnecessary to a full and complete understanding of the invention. These features are described in greater detail in commonly assigned U.S. Pat. No. 5,048,813, which is incorporated herein by reference.

More particularly, the copy machine A of FIG. 1 includes an endless xerographic photoreceptor belt 10 that travels around a closed loop path, herein illustrated as a generally right angle triangular path. The belt is schematically illustrated as travelling in a counterclockwise direction about a series of three rollers 12, 14, 16 and various stations or zones are schematically represented along this closed loop path. The processing stations employed in the copy machine are well known and will only be discussed briefly herein.

The different stations perform the various steps in the xerographic process. For example, along the generally horizontal path illustrated between rollers 12 and 14, the belt is corona charged as schematically represented by station 20. As the belt proceeds leftwardly along the horizontal path, image exposing occurs at work station 22. Due to particular properties of the belt, the image is electrostatically formed on the surface of the belt. The belt then proceeds around the roller 14, and extends in a downward and rightward direction at an angle toward roller 16. Image developing occurs along this portion of the path as represented by work station 24. Toner is applied to the belt at this station, electrostatically adhering thereto and forming a real image in toner on the belt.

Next, the belt proceeds around roller 16 and generally vertically upward through transfer zone or station 26. At the transfer zone, and as its name implies, the toner image is transferred from the photoreceptor belt to copy paper. Specifically, copy paper 30 is provided from one or more trays 32, 34. Although additional paper transport means of conventional construction are used, an input paper baffle 40 directs the copy paper as received from the trays in a generally vertical manner so that it proceeds in a parallel, vertical relation to the belt throughout the transfer zone.

A leading edge 42 of the paper is tacked to the belt. In some arrangements, an additional roller 44 is disposed adjacent roller 16 to define a nip through which the paper 30 is advanced. Thus, in typical design arrangements, as the paper advances toward the transfer zone it is generally planar in configuration and in intimate contact with the surface of the photoreceptor belt. After contacting the photoreceptor belt, the copy sheet is advanced to the transfer zone where transfer coronode 50 causes the transfer of toner from the belt to the copy sheet. The sheet is maintained against the photoreceptor during the transfer process and eventually the leading edge of the sheet reaches, or is advanced beneath, detack coronode 52. Transfer of the image from the belt to the copy paper is thus completed between the coronodes so that as the belt proceeds around roller 12, the copy paper, now carrying the toner image, can proceed to subsequent work stations where the image is fused thereto. The 90° turn of the belt about roller. 12 also enhances separation between the belt and copy paper.

Figure 2:
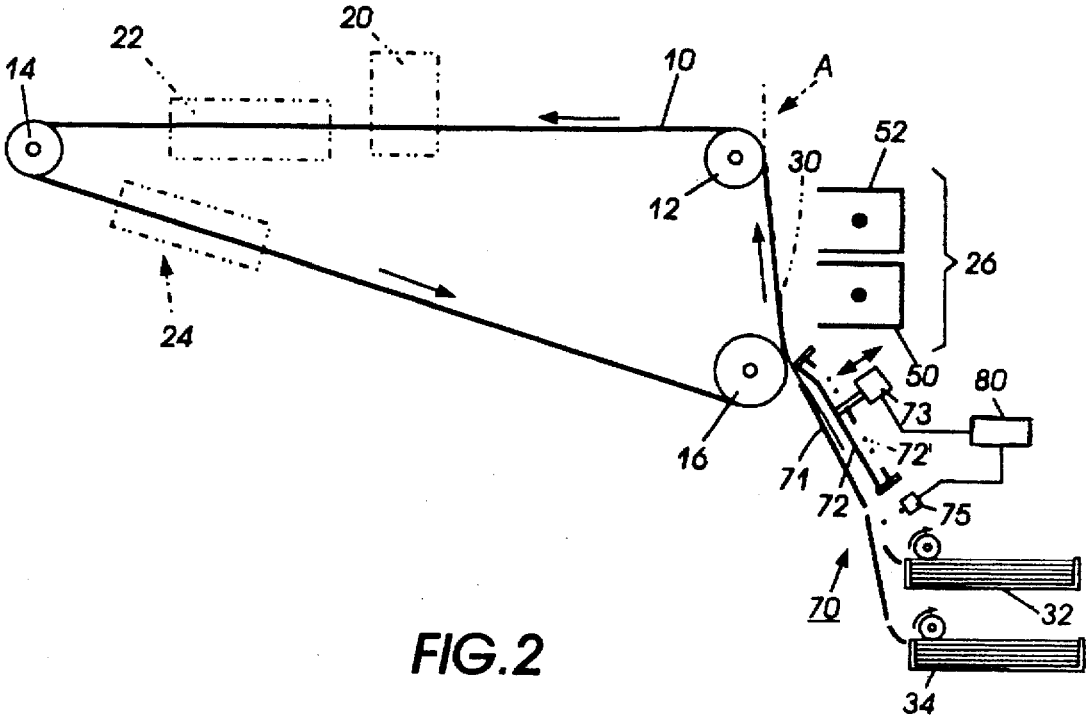
FIG. 2 is an enlarged, partial schematic view of a modified apparatus incorporating the teachings of the subject invention.

To coordinate the following description and relate it to the above general discussion, like numerals in FIGS. 1 and 2 will refer to like elements, while new numerals will identify new elements. More particularly, as shown in FIG. 2, the subject invention modifies the transfer zone by incorporating means for adjusting the spacing between inner surfaces of the pretransfer guides 70 and the spacing of the top guide location to the photoreceptor by driving a positioning mechanism 73. Adjustment of pretransfer guides 70 act to reduce transfer image deletions and essentially involve causing the paper to bend as it contacts the photoreceptor 10 and move the contact line close enough to the transfer device 50 centerline that electrostatic pressure associated with the transfer field occur while the paper is under control of the "S" bend.

In FIG. 2, bottom guide member 71 of sheet guide unit 70 is fixed in a predetermined position with respect to photoreceptor belt 10 while top guide member 72 is connected to a conventional electromechanical device 73 for movement toward and away from photoreceptor 10 in order to change the position that different weight sheets strike photoreceptor 10 to make them contact the photoreceptor as flat as possible and thereby reduce deletion at the transfer station 50. Electromechanical device 73 is controlled by controller 80 that receives a signal from paper basis weight sensor 75 which could be of the type in U.S. Pat. No. 5,138,178 which is incorporated herein by reference. Based on the signal from paper basis weight sensor 73, the position of top guide 72 is moved to a predetermined position, e.g., the position shown in phantom as 72' to give the proper bend to a sheet 30 to flatten it out as it reaches transfer station 50. This image deletion control system with paper basis weight sensor 75 in the pretransfer paper path and top guide member 72 controlled by electromechanical means 73 is adapted to give optimal positioning for top guide member 72 for heavy, as well as, light weight sheets.

In operation, a copy sheet 30 is fed from either of trays 32 or 34 and driven into baffle guide unit 70 toward transfer coronode 50. The copy sheet en route to transfer coronode 50 encounters paper weight sensor 75 which measures the basis weight of the copy sheet and sends a signal of the same to a conventional controller 80. As the sheet 30 enters the sheet path opening between stationary guide 71 and movable guide 72 a signal is sent to conventional electromechanical driving device 73. Electromechanical device 73 is connected to movable guide 72 and based on the signal received from controller 80, moves guide 72 to an optimal position to bend the copy sheet as it contacts the photoreceptor belt 10 and simultaneously move the contact line close enough to the transfer device 50 that electrostatic pressure associated with the transfer field prevents cockled from reforming.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

What is claimed is:

1. In an electrostatographic printing machine having a photoreceptor belt passing through an inlet end of a transfer zone, and copy sheet transport means for supplying a copy sheet to the inlet end of the transfer zone, the improvement for reducing transfer deletions by ensuring a planar transfer zone, characterized by:

a transfer station including a transfer device;

a photoreceptor belt mounted so as to present a planar surface of said photoreceptor belt adjacent said transfer device;

a copy sheet guide unit positioned to guide copy sheets to said transfer station, and wherein said copy sheet guide unit including a stationary guide member and a movable guide member, a displacement device connoted to said movable guide member adapted to have said movable guide member with respect to said stationary guide member and said planar surface of said photoreceptor belt in order to bend said copy sheet as it contacts said planar surface of said photoreceptor belt to reduce image deletion at said transfer station;

a basis weight sensor unit positioned upstream of said copy sheet guide unit and adapted to determine the basis weight of said copy sheet and produce a signal indicative of said basis weight; and a controller, said controller being adapted to receive said signal produced by said basis weight sensor unit and signal said displacement device to position said movable guide member to a predetermined position as determined by the basis weight of said copy sheet.

2. The electrostatographic printing machine of claim 1, wherein said stationary guide member has a single planar sheet contacting surface and said movable guide member has multiple planar sheet contacting surfaces.

3. A method of operating an electrostatographic printing machine having a photoreceptor belt that travels along a predetermined work path, a copy sheet tray for supplying a copy sheet, a copy sheet baffle unit for directing the contact position of the copy sheet against the photoreceptor belt, and a transfer zone defined along the work path that receives the copy sheet from the copy sheet baffle unit for travel along the work path, the method comprising the steps of:

feeding a copy sheet from the copy sheet tray;

receiving copy sheet in the copy sheet baffle unit and feeding a portion of copy sheet from the copy sheet baffle unit toward the photoreceptor belt upstream from transfer zone;

providing the copy sheet baffle unit with a stationary member and a movable member, moving said movable member to provide a predetermined bend in the copy sheet to ensure that the copy sheet contacts the photoreceptor belt at a predetermined angle of incidence;

providing a basis weight sensor unit positioned upstream of the copy sheet baffle unit with said basis weight sensor unit being adapted to determine the basis weight of the copy sheet and produce a signal indicative of the basis weight of the copy sheet; and providing a controller, said controller being adapted to receive said signal produced by said basis weight sensor unit and signal a displacement device to position said movable member to a predetermined position as determined by the basis weight of the copy sheet.

4. The method of claim 3, including the step of providing said stationary member of said copy sheet baffle unit with a continually planar sheet contacting surface and said movable member multiple planar sheet contacting surfaces.

5. An apparatus for ensuring optimal copy quality performance with respect to transfer of images from a photoreceptor to copy sheets having a wide variety of sizes and weights, comprising:

a photoreceptor belt that travels through a predetermined work path;

a transfer zone defined along the work path;

a copy sheet feeder for feeding copy sheets;

a copy sheet baffle unit positioned upstream of said transfer zone and including a stationary baffle and a movable baffle;

a displacement device for moving said movable baffle into a predetermined position in order to ensure that each copy sheet strikes the photoreceptor at a predetermined angle of incidence upstream of said transfer zone;

a basis weight sensor unit positioned upstream of said copy sheet baffle unit and adapted to determine the basis weight of the copy sheet and produce a signal indicative of said basis weight; and a controller, said controller being adapted to receive said signal produced by said basis weight sensor unit and signal said displacement device to position said movable baffle to a predetermined position as determined by the basis weight of the copy sheet.

6. The apparatus of claim 5, wherein said stationary baffle has a single planar sheet contacting surface and said movable baffle has multiple planar sheet contacting surfaces.

* * * * *